US009642479B2

(12) United States Patent
Rizhkov

(10) Patent No.: US 9,642,479 B2
(45) Date of Patent: May 9, 2017

(54) HANGER FOR WALL ART

(71) Applicant: Finic Inc., Portland, OR (US)

(72) Inventor: Vitaliy Rizhkov, Vancouver, WA (US)

(73) Assignee: Finic Inc., Portland, OR (US)

( * ) Notice: Subject to any disclaimer, the term of this patent is extended or adjusted under 35 U.S.C. 154(b) by 248 days.

(21) Appl. No.: 14/629,405

(22) Filed: Feb. 23, 2015

(65) Prior Publication Data

US 2016/0242578 A1 Aug. 25, 2016

(51) Int. Cl.
*A47G 1/16* (2006.01)
*A47G 1/06* (2006.01)

(52) U.S. Cl.
CPC ..... *A47G 1/162* (2013.01); *A47G 1/06* (2013.01); *A47G 1/168* (2013.01)

(58) Field of Classification Search
CPC ..... A47G 1/162; A47G 1/1606
See application file for complete search history.

(56) References Cited

U.S. PATENT DOCUMENTS 1,149,141 A 8/1915 Hook
2,126,630 A * 8/1938 Gleitsman ..... A47G 1/1606 248/222.41
2,549,026 A 4/1951 Skidmore
3,672,622 A * 6/1972 Breslow ..... F16B 12/56 248/223.41
3,861,639 A * 1/1975 Morrill ..... A47G 1/1606 248/489
4,655,428 A * 4/1987 McCrea ..... A47G 1/162 248/456
8,641,001 B2 * 2/2014 Heffernon ..... F16M 11/041 248/224.8
2002/0162925 A1 * 11/2002 Song ..... A47G 1/1606 248/223.41
2007/0210234 A1 * 9/2007 Lin ..... A47G 1/162 248/475.1
2008/0244950 A1 * 10/2008 Golden ..... A47G 1/06 40/777
2013/0160338 A1 * 6/2013 Forbis ..... A47G 1/06 40/711

* cited by examiner

*Primary Examiner* — Gary Hoge
(74) *Attorney, Agent, or Firm* — Klarquist Sparkman, LLP

(57) ABSTRACT

A hanger attachable to an artwork frame includes a base having an open interior and openings at each end, rim and engagement member spanning the interior of the base. A method of mounting a canvas to an artwork frame includes attaching frame members with mating beveled ends to the back of the canvas, trimming margins of the canvas, rotating the frame members and canvas margins 90 degrees such that the frame ends matingly engage one another, and securing the frame ends to one another. Loose margins of the canvas may be folded and secured to the frame and a backing member attached thereto.

14 Claims, 8 Drawing Sheets

HANGER FOR WALL ART

BACKGROUND

The present application relates to a wall hanger for hanging wall-hangings such as art, art work, photographs and wall decor, and a method of mounting a canvas to a frame for hanging on a wall.

Many conventional wall-hanging devices for wall-hangings provide weak support for the object to be hung (especially heavier objects), are time consuming to attach to the back of the wall-hanging, make it difficult to mount the wall-hanging on the wall in a perfectly level manner, and/or do not allow the wall-hanging to be mounted essentially flush against the wall.

In addition, many conventional techniques for mounting art canvas to a frame having some depth leave much to be desired. The resulting frame/canvas assembly is flimsy, creates bumps and uneven surfaces along the side edges of the canvas, fails to provide a secure way of mounting the assembly to the wall, and fails to provide a way to mount the assembly essentially flush against the wall.

Accordingly, there is a need for an improved hanger for wall-hangings such as artwork, photographs, picture frames, wall displays, wall decor and the like. There also is a need for an improved method of mounting to a frame an art canvas imprinted with an art work (i.e., watercolor, oil, pastel), print or reproduction, photograph, photo transfer or the like.

SUMMARY

The present apparatus and method overcomes the foregoing problems and provides a wall-hanging mounting system for securely mounting objects on a wall and mounting a canvas to a frame. The mounting system may include a base having an open interior, a longitudinal center axis, and height and width dimensions. The system further includes a rim projecting outwardly from a front opening of the base and having height and width dimensions which exceed those of the base. The mounting system may include an engagement member having at least one substantially planar surface. The engagement member may extend most or all of the depth of the base from back to front and span the width of the open interior. The engagement member may divide the open interior into two chambers, and may have a wedge-like cross section with two substantially planar surfaces converging to an edge spanning either a front opening of the interior space or a rear opening of the interior space.

A method of mounting a canvas may include cutting or forming four frame members having mating beveled ends, the ends being beveled by 45 degrees in one illustrated embodiment. The frame members are attached to the back of one canvas by adhesion or otherwise, preferably such that inner edges of the frame members form a continuous four-sided polygon and without any frame member intersecting the path of an adjacent frame member. Substantially triangular corner margin sections are trimmed from the canvas at the four corners, preferably by making diagonal cuts aligned with outer corners of adjacent frame members.

Smaller canvas sections located between the ends of adjacent frame members are cut to bisect the canvas sections. Each bisected canvas section may be folded and adhered (or otherwise attached) to the beveled end of an adjacent frame member. The frame members and canvas portions attached thereto then are serially rotated upwardly by 90 degrees and adjacent mating beveled ends joined to one another by adhesion or otherwise, thereby forming a frame having a hollow interior with a depth corresponding generally to the thickness of the frame members. Loose canvas margins may be folded inwardly and adhered or otherwise attached to the frame members. A backing member sufficient to support the canvas and frame may be secured to the frame members to enclose the interior space at the back of the frame.

A hole corresponding to the base of the hanger described above may be cut or formed in the backing member to allow the hanger to securely mounted therein by press fit adhesion or otherwise. The hangar may have a generally cylindrical configuration with a through-hole, four side square or rectangular configuration, or in other configuration. The resulting canvas frame and hanger assembly may be mounted to hang on a "J" style bracket or other mounting member anchored to a wall.

BRIEF DESCRIPTION OF THE DRAWINGS

One embodiment of the present invention is described in detail below with reference to the attached drawing figures, wherein.

DETAILED DESCRIPTION OF PREFERRED EMBODIMENTS

Figure 1:
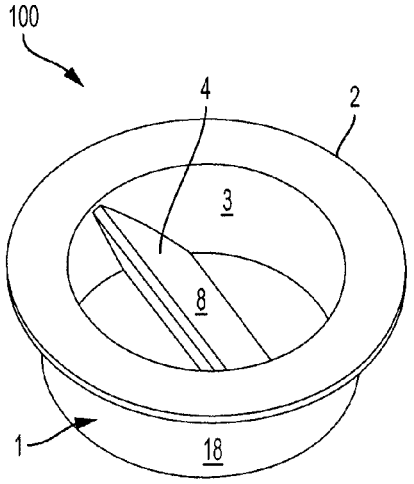
FIG. 1 is a perspective front view of a wall hanger that may be mounted to the back of a wall-hanging in accordance with one exemplary embodiment.

By way of definition, the term "wall-hanging" is used in its broadest sense to refer to an object that may be mounted on a frame and hung on a wall for aesthetic or decorative purposes, such as art, art work, art piece, wall display, award case, etc. The term "canvas" is used in the broadest sense to refer to durable medium to which an art image may be applied, including traditional art canvas, art paper and boards, multi-media paper, parchment and the like, and which is flexible enough to be wrapped or folded around a frame.

The terms upper, lower, top, bottom, above, below and like terms are not used in their absolute sense to indicate orientation or direction but are used in their relative sense to provide a frame of reference.

The present wall hanger, wall-hanging frame, method of constructing an artwork frame and method of mounting an art canvas to the frame are susceptible to many different forms. While the drawings illustrate, and the specification describes, certain illustrative embodiments of the inventions, it is to be understood that such disclosure is by way of example only. There is no attempt to limit the principles disclosed and inherent in the disclosure to the particular disclosed embodiments.

A mounting member or wall hanger 100 for mounting wall-hangings to a wall is illustrated in FIGS. 1-4. The hanger 100 may be mounted to the back of a wall-hanging, such as an art piece, art canvas, print, photograph, picture frame, wall display or the like. The resulting wall-hanging assembly may be hung or mounted on a bracket, nail, "J" style picture hanger, wall-anchored projection or other mounting member secured or anchored to the wall. The hanger is especially well suited for mounting or hanging a wall-hanging having a hollow frame that gives the wall-hanging a depth or thickness greater than "slim profile" wall-hangings.

The hanger 100 includes a housing or base 1 having a substantially cylindrical shape in one exemplary embodiment. The base 1 has a bore or open interior defined by an inner bore wall 3. At one open end of the bore wall 3, the base 1 is joined to an annular rim 2 having a diameter greater than both the bore wall 3 and an outer wall of the base 1. Thus the rim has height and width dimensions greater than corresponding dimensions of the base. The rim 2 has a substantially flat annular surface capable of abutting flush against a flat wall surface. The rim extends in a plane that is substantially perpendicular to a longitudinal center axis of the base.

The hanger further includes a bracket engagement member 4 that preferably spans the width of the bore and is secured at both ends to the bore wall 3. The engagement member 4 serves as a supporting element to engage a mounting element secured to the wall. In the illustrated example shown best in FIGS. 1 and 4, the engagement member 4 is a substantially triangular or wedge-like member that divides the bore generally into two chambers, a first chamber 5 and second chamber 6.

Figure 3:
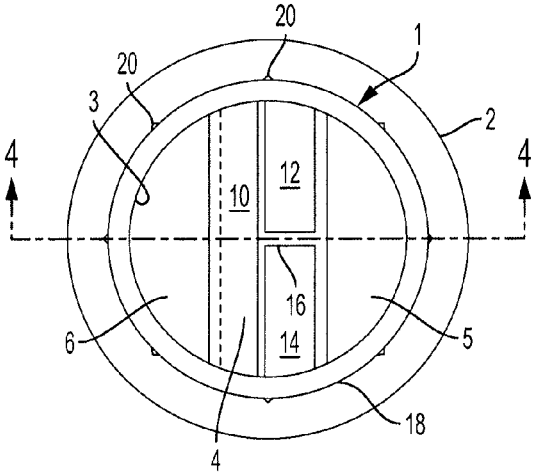
FIG. 3 is a rear plan view of the hanger of FIG. 1.
Figure 4:
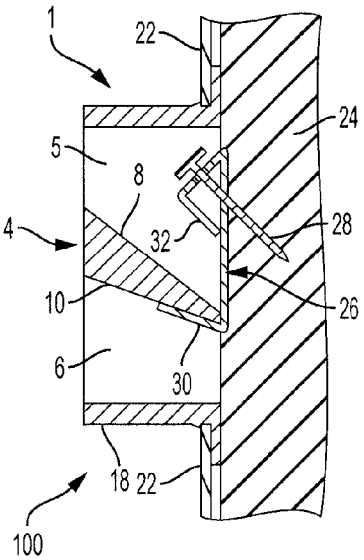
FIG. 4 is a cross section view taken along line 4-4 of FIG. 3, and additionally showing the hanger mounted to the back of a wall-hanging and the resulting assembly mounted to a wall.

In the illustrated example the engagement member 4 preferably has a first substantially planar or flat surface 8 (FIG. 1) and generally opposed, second substantially planar or flat surface 10 (FIG. 3). Surfaces 8, 10 converge to a leading edge that terminates proximate to a front opening of the base 1 as FIG. 4 illustrates. A rear surface of the engagement member 4 preferably defines a pair of rear recesses 12, 14 (FIG. 3) separated by a reinforcing rib 16.

In the illustrated example, the engagement member 4 extends at least substantially the full length of the bore, extending from a rear opening of the base 1 to a front opening where the rim 2 joins the base. It will be appreciated that the surfaces 8, 10 of the wedge-like engagement member 4 define an acute angle therebetween, preferably ranging from about 10-40 degrees, and most preferably about 25 degrees. Surfaces 8, 10 also define surfaces which extend at an angle to and intersect the longitudinal center axis of the hanger. Put another way, the engagement member 4 extends generally downwardly in ramp-like fashion from the rear edge of the base 1 to the front opening where rim 2 is located.

It will be appreciated that the engagement member 4 may have many configurations and orientations and still provide a catch or support for engaging a mounting anchor or mounting projection fixed to the wall. For example, the engagement member may take the form of a plate-like member having substantially parallel, opposing sides, rather than converging sides like those of the wedge shaped engagement member illustrated. The engagement member also may be formed as a solid piece without the recesses 12, 14 and reinforcing rib 16. The engagement member further may take the form of a rod or beam-like member that spans the front opening of the base and is secured or anchored at opposite ends to the bore wall 3. The engagement member may take the form of a wedge-shaped member in which a flat surface faces forwardly toward the vertical wall and adjacent walls converge to an edge located proximate the rear end of the base 1. The engagement member serves to provide a support or catch that engages an anchor or other support which is anchored to and projects outwardly from the vertical wall, while leaving open interior space above and below the engagement member to receive the mounting anchor or other wall support.

FIG. 3 illustrates that the engagement member spans the bore defined by the bore wall 3 and has a height projection or profile that occupies about the middle one-third of the bore. FIG. 3 also shows that the diameter of the rim 2 exceeds the diameter of the base's outer wall 18 (and that the rim's height and width dimensions exceed corresponding dimensions of the base 1).

Figure 2:
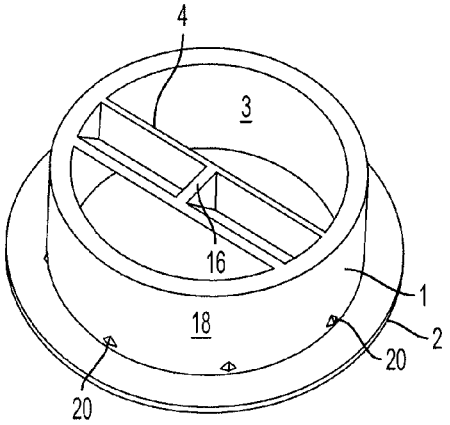
FIG. 2 is a perspective rear view of the hanger of FIG. 1.

Referring to FIGS. 2 and 3, the outer cylindrical wall 18 of the base 1 may be provided with small frame engaging projections 20 spaced around the wall 18 to provide a more secure connection between the hanger and frame of the wall-hanging.

As shown in FIG. 4, the hanger 100 may be mounted or attached to a backing member 22 of a wall-hanging having a hollow interior. The hanger is attached to the backing member 22 by cutting or forming an opening in the backing member 22 that conforms to the shape of the base member 1. The diameter of the opening is about the same as the diameter of the outer cylindrical wall 18. The hanger may be securely fixed or anchored to the backing member in many ways, such as by press fit or adhesion, with the projections 22 securing the connection.

The resulting wall-hanging and hanger assembly may be removably hung, secured or otherwise mounted to a vertical wall 24 using many different types of conventional wall mounting devices. FIG. 4 illustrates one common mounting device in the form of a "J" style picture frame hanger 26 which is secured to the wall 24 by a nail 28. The "J" hanger 26 typically includes a lower support portion 30 that projects into the chamber 6 and supportively engages the flat surface 10 of the engagement member 4. In one example, the portion 30 and surface 10 form substantially the same acute angle with the main body of "J" hanger 26, such that the surface 10 supportively rests substantially flush against portion 30. The "J" hanger also typically includes a triangle-shaped upper portion 32 that projects into the upper chamber 5 and defines a pair of aligned openings to receive the nail 28. The nail 28 is embedded in the wall 24 to provide a secure connection. It will be appreciated that the hanger's centrally located engagement member 4 and upper and lower chambers formed above and below the engagement member allow projecting portions of the "J" hanger 26 to be positioned within the bore of the wall hanger, thereby enabling the backing member 22 of the wall-hanging to be mounted substantially flush against the wall 24. The hanger 100 requires minimal clearance between the backing member 22 and wall 24 to accommodate the "J" hanger 26, nail 28 or other wall-anchored support.

The base 1, rim 2, engagement member 4 and other components of the wall hanger may be integrally formed by many conventional manufacturing methods, such as molding (e.g. injection molding), extrusion, and casting. The hanger may be made of any material sufficient to support the weight of the wall-hanging, including for example, plastics such as polypropylene or polyethylene, UHMW material, etc. The hanger also may be made from metals, composite materials or other materials sufficiently strong to support the wall-hanging (and its frame).

Figure 14:
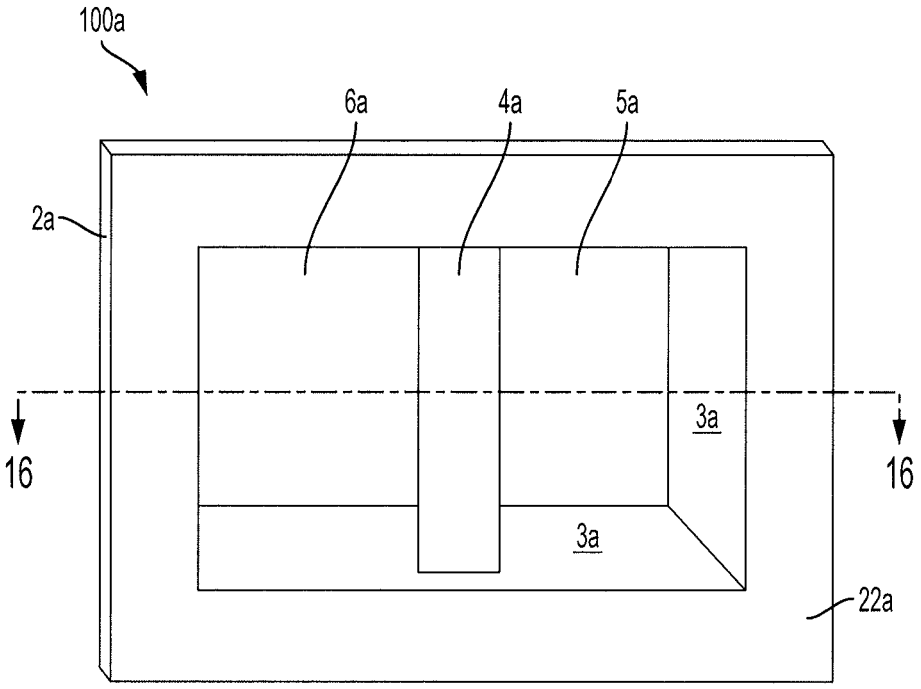
FIG. 14 is a perspective front view of a wall hanger in accordance with a second embodiment.
Figure 15:
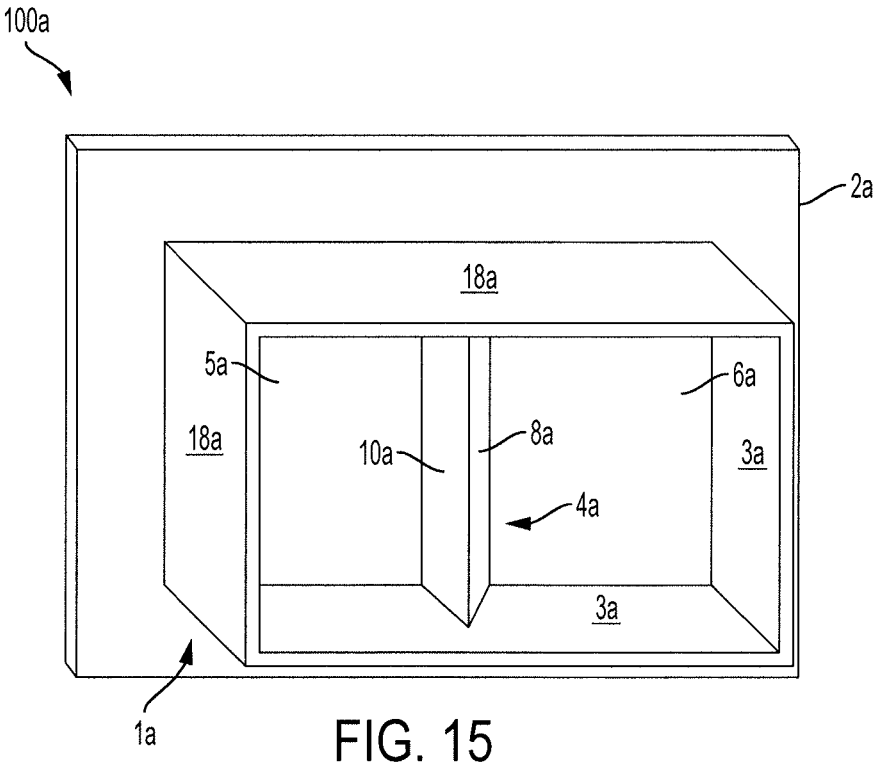
FIG. 15 is a perspective rear view of the hanger in FIG. 14.
Figure 16:
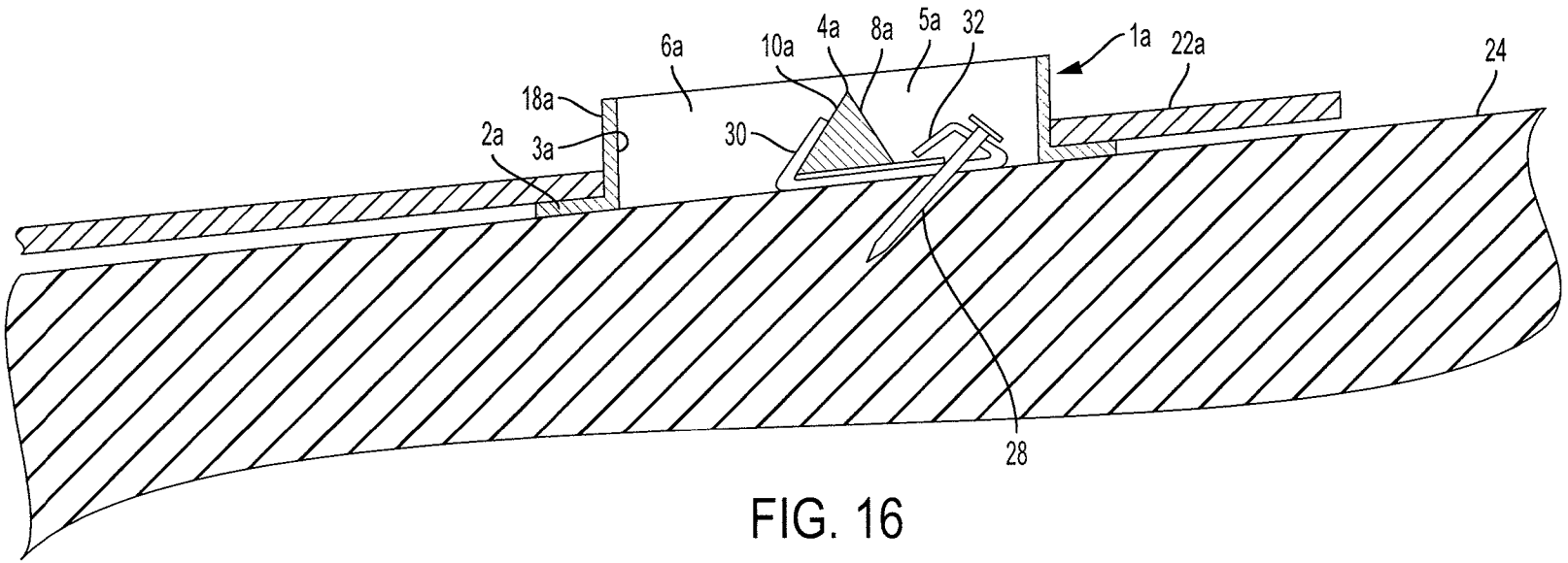
FIG. 16 is a cross sectional view taken along line 16-16 of FIG. 14, and additionally showing the hanger mounted to the back of a wall-hanging and the resulting assembly mounted to a wall.

An alternative wall hanger embodiment is shown in FIGS. 14-16. The wall hanger 100*a* includes a housing or base 1*a* having a substantially square or rectangular configuration. The base 1*a* has a four-sided interior wall 3*a* that defines an interior space. At a forward open end of the wall 3*a*, the base 1*a* is joined to a rim 2*a* having length and width dimensions greater than the length and width dimensions of both inner wall 3*a* and an outer wall 18*a* of the base. The rim 2*a* has a flat wall-facing surface capable of abutting flush against a flat wall surface.

The hanger 100*a* further includes a bracket engagement member 4*a* that preferably spans the width of the base and is secured at both ends to the inner wall 3*a*. As with the first embodiment, the engagement member 4*a* preferably is a triangular or wedge-like member that divides the interior into two chambers 5*a*, 6*a*. Unlike member 4, engagement member 4*a* is a solid component without rear recesses and has a pair of planar surfaces that converge to an edge at a rear end of the base (rather than the front end).

Otherwise, the construction and operation of the wall hanger 100*a* is the same as the hanger 100 previously described.

Referring to FIGS. 5-13 a wall-hanging frame and method of mounting a canvas to a frame will now be described. The frame may include a hanger as described above.

Figure 5:
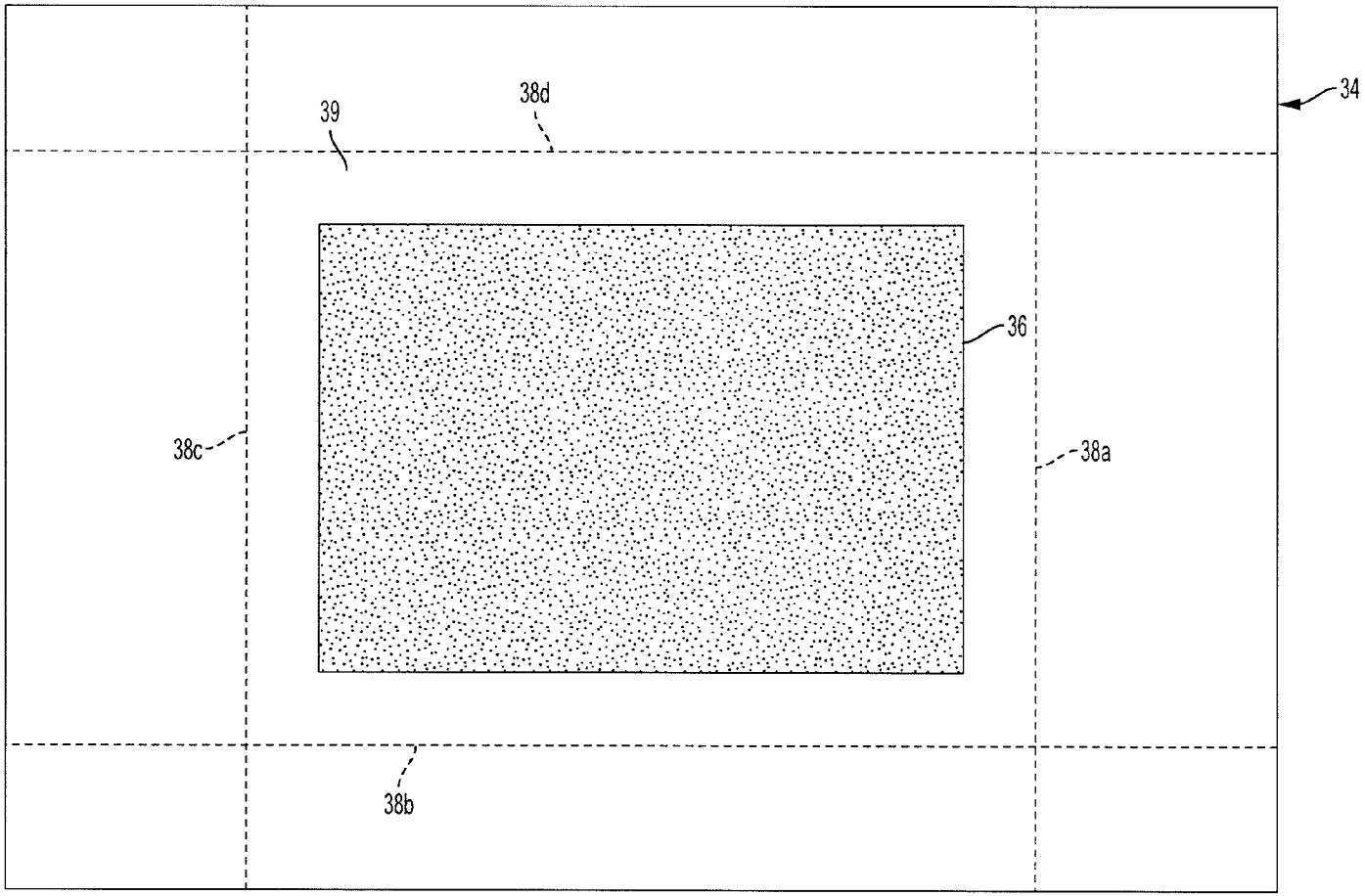
FIG. 5 is a front plan view of art work imprinted on a canvas having margins.
Figure 6:
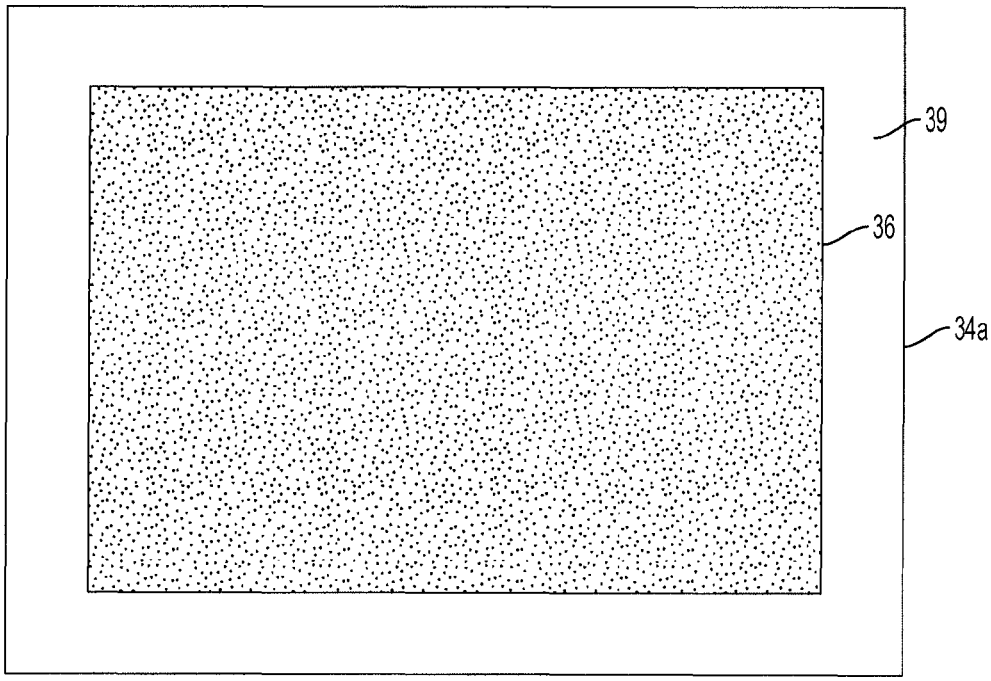
FIG. 6 is a front plan view of the canvas of FIG. 5 with its margins trimmed.

FIG. 5 illustrates the front of a pliable, foldable canvas 34 having an image 36 affixed thereto. The image 36 may be a watercolor, oil, photograph, pencil sketch, print, photo transfer or any other type of aesthetic work or image imprinted or otherwise transferred to the canvas. Initially, any excess margins of the canvas 34 are trimmed along trim lines 38*a*, 38*b*, 38*c*, 38*d* to produce a trimmed canvas 34*a* (shown in FIG. 6) preferably having a uniform margin 39. The margin 39 preferably is sufficient to allow the canvas to be wrapped around the sides and back of a frame. The wrap around portion of the margin may include peripheral edges of the image 36.

Figure 7:
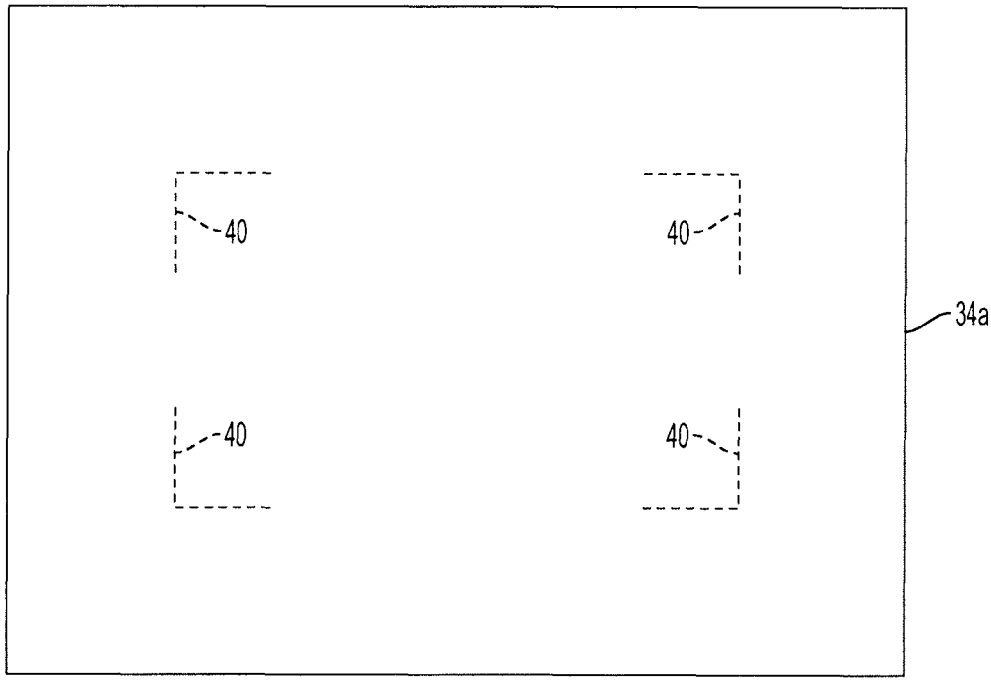
FIG. 7 is a rear plan view of the canvas of FIG. 6 with guidelines inscribed on the canvas.
Figure 8:
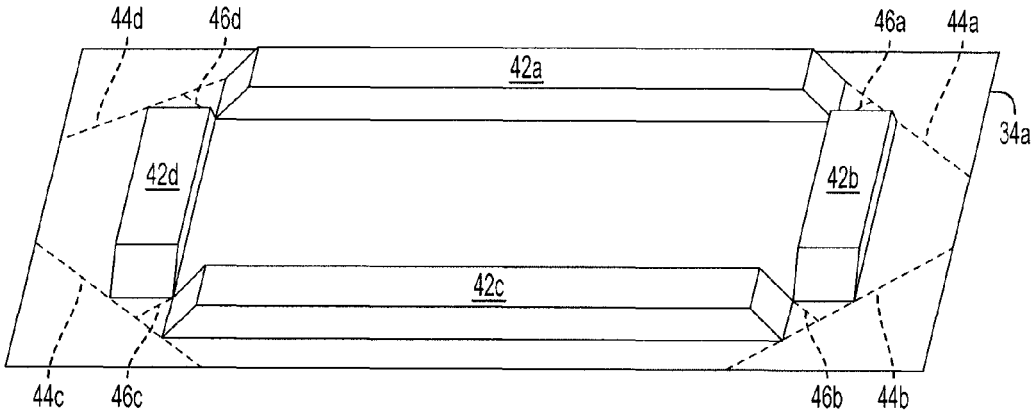
FIG. 8 is a rear perspective view of the canvas of FIG. 8 with frame pieces attached thereto.

The canvas then is flipped over and right angle shaped guide lines 40 are inscribed proximate to each corner of the canvas, as illustrated in FIG. 7. The guide lines 40, which have legs parallel to the edges of the canvas, serve as an alignment guide for the inner edge of four frame members 42*a*, 42*b*, 42*c*, 42*d* (FIG. 8). The guide lines can be located appropriately depending on the dimensions of the canvas and image, desired margin width, desired amount of wrap, frame member dimensions, etc. The frame members are preferably formed by cutting wood stock to an appropriate length suitable for the particular canvas dimensions and cutting or forming 45 degree beveled ends in each frame member 42*a*, 42*b*, 42*c*, 42*d*. The frame members preferably are made of wood, which is a sturdy and inexpensive material, but also may be made from metal, plastic, composite and other materials. All frame members may have the same length to form a square frame. Alternatively, opposing frame members may have the same length as each other but different lengths from the other pair to form a rectangular frame.

As shown in FIG. 8, the frame members preferably are attached to the back of the canvas 34*a* by applying adhesive to appropriate locations of the canvas, canvas-facing surfaces of the frame members, or both, and then pressing the frame members against the canvas to promote adhesion. The frame members are positioned on the canvas using the guide lines 40 to align the inner edge of each frame member on the canvas as well as the ends of each frame member relative to adjacent frame ends. The length of the frame members preferably is such that each frame member spans the distance between adjacent frame members without crossing paths with the adjacent frame members. Stated differently, the inner corners of each frame member terminate in close, almost touching proximity to the corresponding inner corner of the adjacent frame member (as FIG. 8 shows). The inner edges of the frame members form a four-sided polygon without overlapping an adjacent frame member. Thus, each frame member preferably has a length equal to the distance between inner edges of adjacent parallel frame members. Each frame member preferably has the same width and depth/thickness dimensions.

Figure 9:
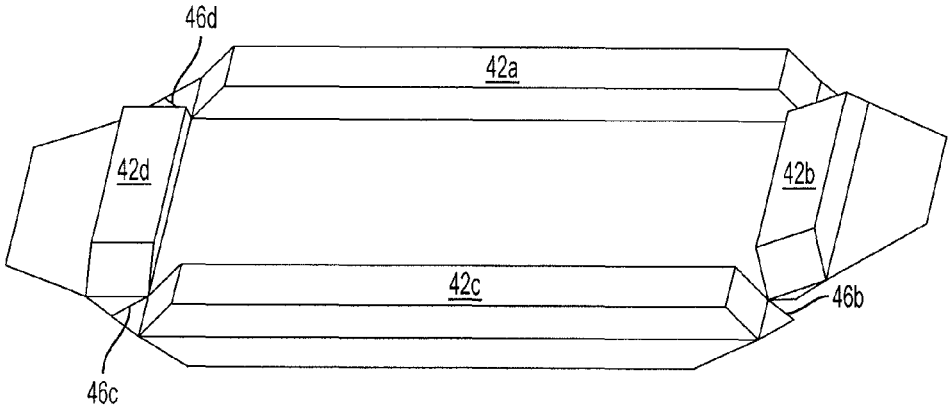
FIG. 9 is a rear perspective view of the canvas and frame pieces of FIG. 8 with margins of the canvas trimmed.

Once the frame members are adhered or otherwise affixed to the canvas 34*a*, the margins of the canvas are trimmed further by removing triangular shaped corners of the canvas by cutting along diagonal lines 44*a*, 44*b*, 44*c*, 44*d* (FIG. 8), thereby leaving small triangular shaped canvas sections adjacent to the beveled ends of the frame members. The cut lines 44 generally are aligned with two outer corners of adjacent frame members. As the diagonal cuts are made or thereafter, the remaining small triangular canvas sections are bisected by making cuts along lines 46*a*, 46*b*, 46*c*, 46*d*, leaving the frame and canvas assembly as shown in FIG. 9.

Figure 10:
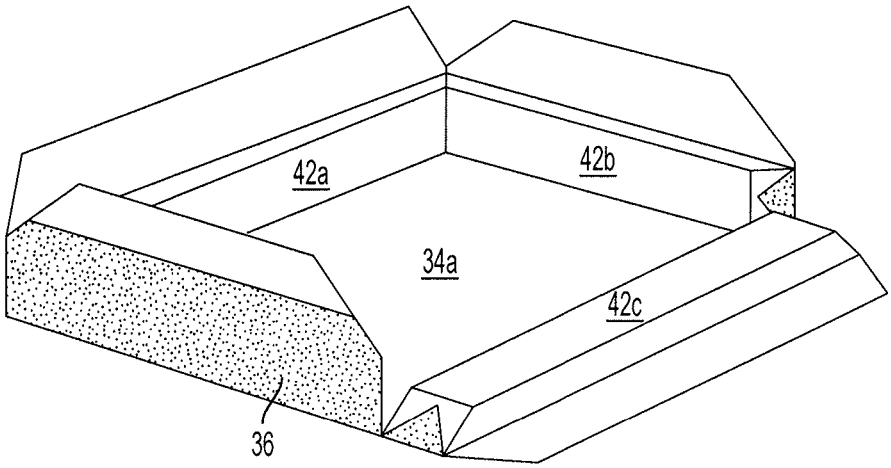
FIG. 10 is a rear perspective view of the canvas and frame pieces of FIG. 9 in a partially assembled condition.

If not applied previously, glue is applied to the remaining margins (backside) of the canvas, including the small bisected triangular canvas sections and beveled frame ends. The small triangular canvas sections are folded upwardly and adhered to respective beveled ends of the frame members, as illustrated in FIG. 10. Next, adjacent frame sections 42*a*, 42*b*, 42*c*, 42*d* and canvas portions adhered thereto are serially folded up and inwardly by 90 degrees such that the adjacent beveled ends contact and become adhered to one another, as illustrated in FIG. 10 (sandwiching the triangular canvas sections therebetween). In this way, a continuous frame is formed with each frame member in supporting contact with adjacent frame members. When all four frame members have been rotated up and inwardly to be joined to adjacent frame members, a square or rectangular frame having some depth is formed, with loose remaining canvas margins extending vertically beyond the frame members. The interior area between the frame members forms a hollow space or interior.

Figure 11:
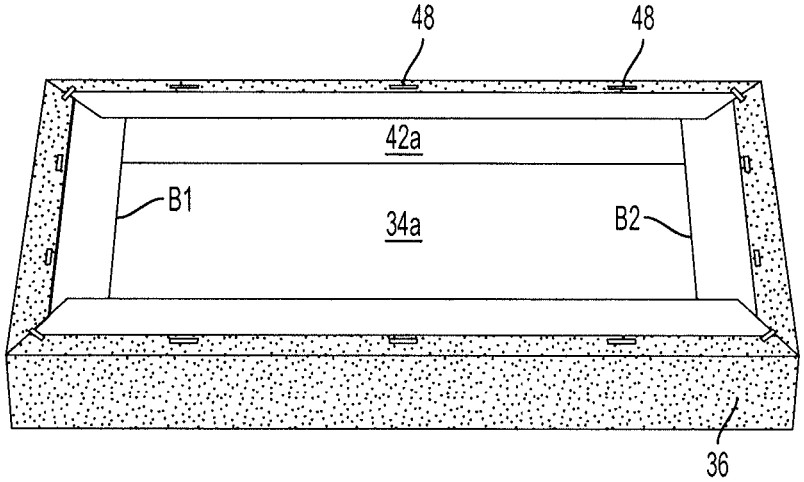
FIG. 11 is a rear perspective view of the canvas and frame pieces of FIG. 10 in a fully assembled condition with loose canvas margins secured to the frame.

As illustrated in FIG. 11, the remaining loose canvas margins are then folded downwardly and glued, stapled and/or nailed to their respective frame members. For example, staples 48 are shown embedded in the rear surface of the frame members (which are hidden by the canvas margins) to secure the edges of the canvas to the frame members. The folded canvas margins or edges may terminate short of the full width of the frame members, may terminate at the edge of the frame members or, as shown in FIG. 11 may extend beyond the width of the frame members. The frame so formed gives the frame some depth and a hollow interior and covers the sides of the frame. When the dimensions are selected properly, the image portion 36 of the canvas can be wrapped around the sides of the frame to give the sides of the frame an aesthetic look, and give the artwork an aesthetic, three dimensional appearance.

Figure 12:
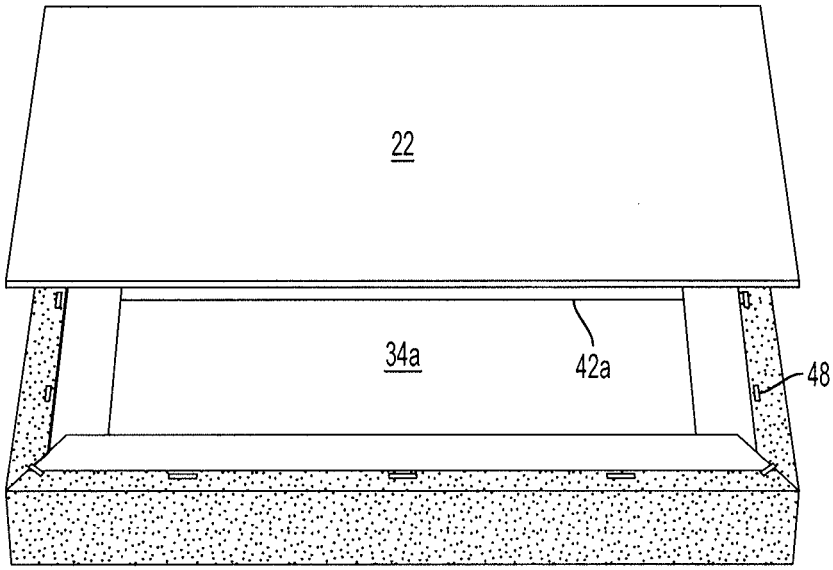
FIG. 12 is a rear perspective view of the canvas and frame of FIG. 11 with a backing member about to be secured thereto.
Figure 13:
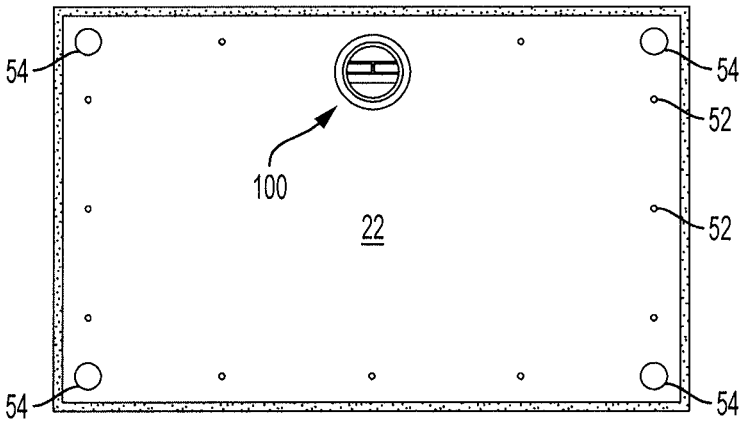
FIG. 13 is a rear plan view of the complete canvas and frame assembly, with a wall hanger mounted thereto.

Referring to FIG. 12, a backing member 22 may be attached to the frame by adhesion, nails, staples or other securing means. FIG. 13 shows the backing member 22 secured to the frame by nails 52, and soft slip-resisting polyurethane tabs 54 secured to the corners of the backing member to minimize slippage of the wall-hanging on the wall. FIG. 13 also shows that the hollow interior of the frame allows a hanger 100 as described above to be affixed to the frame by cutting a complementary sized and shaped opening in the backing member 22 and then securing the hanger member in place within the opening.

It will be apparent to one of routine skill that some of the above steps should be carried out in a sequential order while other steps do not necessarily need to be executed in the exemplary order described. As one example, the opening formed or cut in the backing member 22 may be formed or cut before or after the backing member is secured to the frame.

I claim:

1. A hanger mountable to a wall-hanging frame comprising:

a base having an open interior, a front opening and a rear opening, a longitudinal center axis, and first height and width dimensions;

a rim projecting outwardly from the front opening and having second height and width dimensions greater than the first height and width dimensions, the rim extending substantially perpendicularly to the longitudinal center axis; and an engagement member having at least one substantially planar surface extending substantially from the rear to the front opening and spanning substantially the full width of the front opening.

2. The hanger of claim 1 wherein the base is substantially cylindrical.

3. The hanger of claim 1 wherein the base is substantially rectangular.

4. The hanger of claim 1 wherein the engagement member is secured to the base at an acute angle relative to the longitudinal center axis and defines a plane that intersects the longitudinal center axis.

5. The hanger of claim 1 wherein the acute angle is about 10 to 40 degrees.

6. The hanger of claim 1 wherein the engagement member has a substantially wedge-like cross section.

7. The hanger of claim 1 wherein the engagement member has two substantially planar surfaces that converge to an edge.

8. A hanger according to claim 1 wherein the engagement member divides the interior into first and second chambers.

9. A hanger according to claim 1 in combination with a wall-hanging frame having a backing member, the backing member having an opening that matingly seats the base of the hanger, such that the rim sits flush against the backing member.

10. A hanger according to claim 9 wherein the engagement member divides the interior into first and second chambers.

11. A hanger according to claim 10 in combination with a wall-anchored projection having first and second portions, wherein the wall-hanging frame and hanger are mounted on the wall-anchored projection, wherein the first portion projects into the first chamber and the second portion projects into the second chamber.

12. A wall-hanging system comprising:

a wall-hanging having a first hollow interior and a backing member substantially enclosing the first hollow interior; and a hanger mounted within a complementary shaped opening in the backing member, and projecting into the first hollow interior of the wall-hanging;

the hanger having a base with a second hollow interior, a rim projecting outwardly from a first end of the base and resting flush against the backing member when the hanger is seated in the opening, and an engagement member;

wherein the engagement member spans a width of the second hollow interior, is attached at opposite ends to the base and divides the second hollow interior into two chambers, the engagement member having at least one substantially flat surface that defines a plane that intersects a longitudinal center axis of the base, the engagement member extending substantially from a rear end of the base to a front end of the base.

13. The system of claim 12 wherein the base is substantially cylindrical.

14. The system of claim 12 wherein the base is substantially rectangular.

* * * * *